US008764437B2

(12) United States Patent
Ryu et al.

(10) Patent No.: US 8,764,437 B2
(45) Date of Patent: Jul. 1, 2014

(54) BURNER AND COOKER INCLUDING THE BURNER

(75) Inventors: Jungwan Ryu, Seoul (KR); Youngsoo Kim, Seoul (KR); Daebong Yang, Seoul (KR)

(73) Assignee: LG Electronics Inc., Seoul (KR)

( * ) Notice: Subject to any disclaimer, the term of this patent is extended or adjusted under 35 U.S.C. 154(b) by 89 days.

(21) Appl. No.: 13/446,904

(22) Filed: Apr. 13, 2012

(65) Prior Publication Data

US 2012/0266862 A1 Oct. 25, 2012

(30) Foreign Application Priority Data

Apr. 19, 2011 (KR) ..... 10-2011-0036426

(51) Int. Cl.
*F24C 3/08* (2006.01)

(52) U.S. Cl.
USPC ..... 431/354; 126/39 E; 126/39 R

(58) Field of Classification Search
USPC ..... 126/39 R, 39 E, 273 R; 431/129, 130, 431/354
See application file for complete search history.

(56) References Cited

U.S. PATENT DOCUMENTS 3,619,099 A * 11/1971 Moss et al. ..... 431/192

* cited by examiner

*Primary Examiner* — Alfred Basichas
(74) *Attorney, Agent, or Firm* — Birch, Stewart, Kolasch & Birch, LLP

(57) ABSTRACT

A burner and a cooker including the burner are provided. The burner includes a burner port, an ignition unit configured to ignite a mixture gas in the burner port, a combustion member located between the burner port and the ignition unit, a plurality of combustion compartments defined by portions of the burner port and the combustion member to allow combustion of the mixture gas in the combustion compartments, and an ignition compartment defined by the remaining portions of the burner port and the combustion member to allow ignition of the mixture gas supplied from the combustion compartments, whereby a flame generated by igniting the mixture gas in the ignition compartment is propagated to the combustion compartments. The cooker includes a cooking cavity, the burner, mixing tubes for the mixture of gas, and a door closing the cooking cavity.

20 Claims, 12 Drawing Sheets

BURNER AND COOKER INCLUDING THE BURNER

CROSS-REFERENCE TO RELATED APPLICATIONS

The present application claims priority under 35 U.S.C. 119 to Korean Patent Application No. 10-2011-0036426, filed on Apr. 19, 2011, which is hereby incorporated by reference in its entirety.

BACKGROUND OF THE DISCLOSURE

1. Field of the Disclosure

The present disclosure relates to a burner and a cooker including the burner.

2. Description of the Related Art

Cookers are used to cook food by heating the food using gas or electricity. Cookers using gas as fuel include a burner for heating food by burning gas. For example, an infrared burner provides thermal energy necessary for heating food by burning a mixture of air and gas on the surface of a combustion member. Such an infrared burner includes a burner port and a combustion member. The mixture gas supplied to the burner port may be burned on the combustion member.

Generally, the burner port has a hexahedral shape with an opened side. Thus, the supplied mixture gas may flow uniformly throughout the inside of the burner port, and thus the mixture gas may be uniformly burned on the entire surface of the combustion member. Usually, the combustion member has a rectangle or square shape.

The infrared burner is usually disposed in a cooking chamber in which food is placed for cooking. The cross sectional area of the infrared burner (that is, the cross sectional areas of the burner port and the combustion member) is determined according to the cross sectional area of the cooking chamber for uniformly heating the inside of the cooking chamber.

The combustion member is usually formed of a ceramic material. Thus, if the combustion member has a rectangle or square shape corresponding to the cross sectional shape of the cooking chamber, it may be necessary to reinforce the combustion member to prevent deflection of the combustion member. The strength of the combustion member may be improved by increasing the thickness of the combustion member. However, in this case, the thickness of the infrared burner is also increased.

Alternatively, a plurality of infrared burners having relatively small cross sectional areas may be disposed in a cooking chamber. However, in this case, a plurality of ignition units may be necessary to ignite the mixture gas on the surfaces of combustion members.

BRIEF SUMMARY OF THE EXEMPLARY EMBODIMENTS

Exemplary embodiments provide a burner having a simple structure and may be configured to uniformly heat the inside of a cooking chamber, and a cooker including the burner.

In one exemplary embodiment, a burner is provided. The burner includes a burner port, an ignition unit configured to ignite a mixture gas in the burner port, a combustion member located between the burner port and the ignition unit, a plurality of combustion compartments defined by portions of the burner port and the combustion member to allow combustion of the mixture gas in the combustion compartments, and an ignition compartment defined by the remaining portions of the burner port and the combustion member to allow ignition of the mixture gas supplied from the combustion compartments, whereby a flame generated by igniting the mixture gas in the ignition compartment is propagated to the combustion compartments.

In another exemplary embodiment, the burner may include a burner port including a flow passage to provide a mixture gas of air and gas, a combustion member located on the flow passage, and an ignition unit configured to ignite the mixture gas. The flow passage includes a plurality of combustion flow passages to which the mixture gas is supplied, and an ignition flow passage communicating with the combustion flow passages to receive the mixture gas. A first surface portion of the combustion member is located in the ignition flow passage and second surface portions of the combustion member are located in corresponding combustion flow passages. When the mixture gas is ignited by the ignition unit at the first surface portion of the combustion member, a flame is generated and propagated to the second surface portions of the combustion member corresponding to the combustion flow passages.

In yet another exemplary embodiment, a cooker is provided. The cooker may include a cavity part defining a cooking chamber configured to receive food, a burner configured to supply heat to the cooking chamber for cooking food, and a door configured to selectively close or open the cooking chamber. The burner includes a burner port, an ignition unit configured to ignite a mixture gas in the burner port, a combustion member located between the burner port and the ignition unit, a plurality of mixing tubes connected to the burner port, a plurality of combustion compartments defined by portions of the burner port and the combustion member to allow combustion of the mixture gas in the combustion compartments, each combustion compartment being in communication with a corresponding mixing tube, and an ignition compartment defined by the remaining portions of the burner port and the combustion member to allow ignition of the mixture gas supplied from the combustion compartments, whereby a flame generated by igniting the mixture gas in the ignition compartment is propagated to the combustion compartments.

The details of one or more exemplary embodiments are set forth in the accompanying drawings and the description below. Other features will be apparent from the description and drawings, and from the claims.

BRIEF DESCRIPTION OF THE DRAWINGS

The present disclosure will become more fully understood from the detailed description given hereinbelow and the accompanying drawings which are given by way of illustration only, and thus are not limitative of the present disclosure and wherein.

DETAILED DESCRIPTION OF THE INVENTION

Hereinafter, an explanation will be given of an exemplary structure of a cooker according to a first embodiment with reference to the accompanying drawings.

Figure 1:
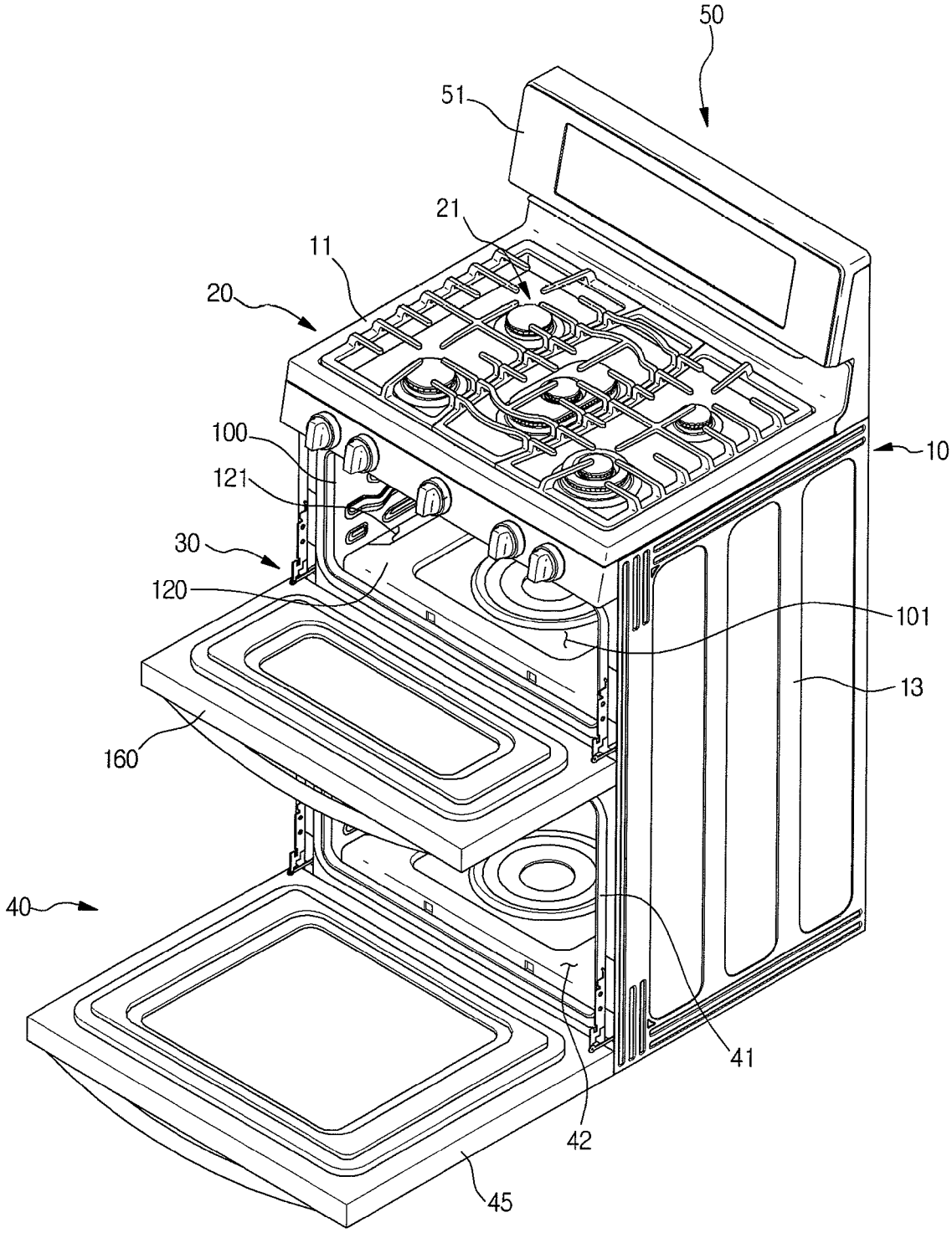
FIG. 1 is a perspective view illustrating a cooker according to a first embodiment.
Figure 2:
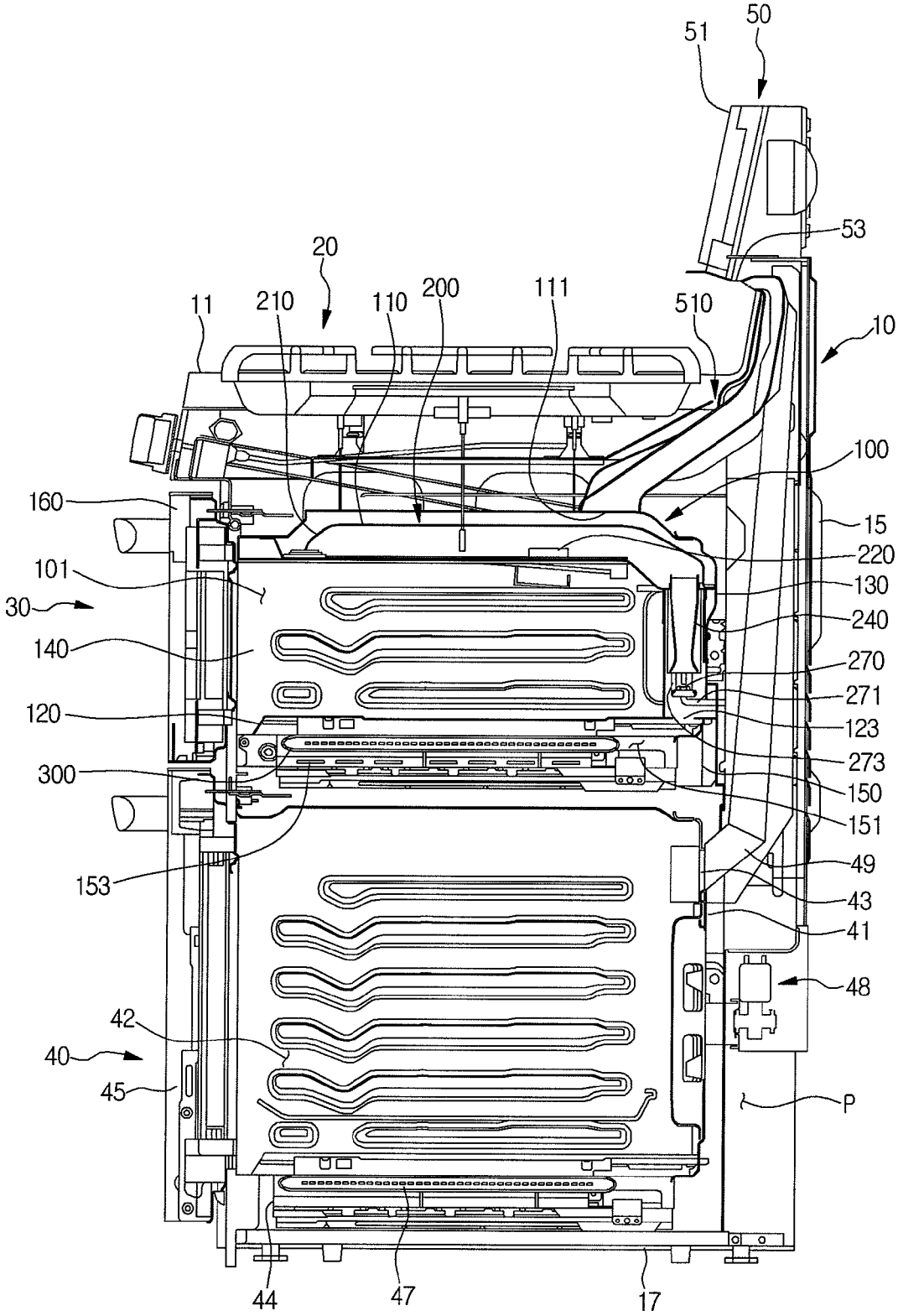
FIG. 2 is a vertical sectional view illustrating main parts of the cooker of the first embodiment.
Figure 3:
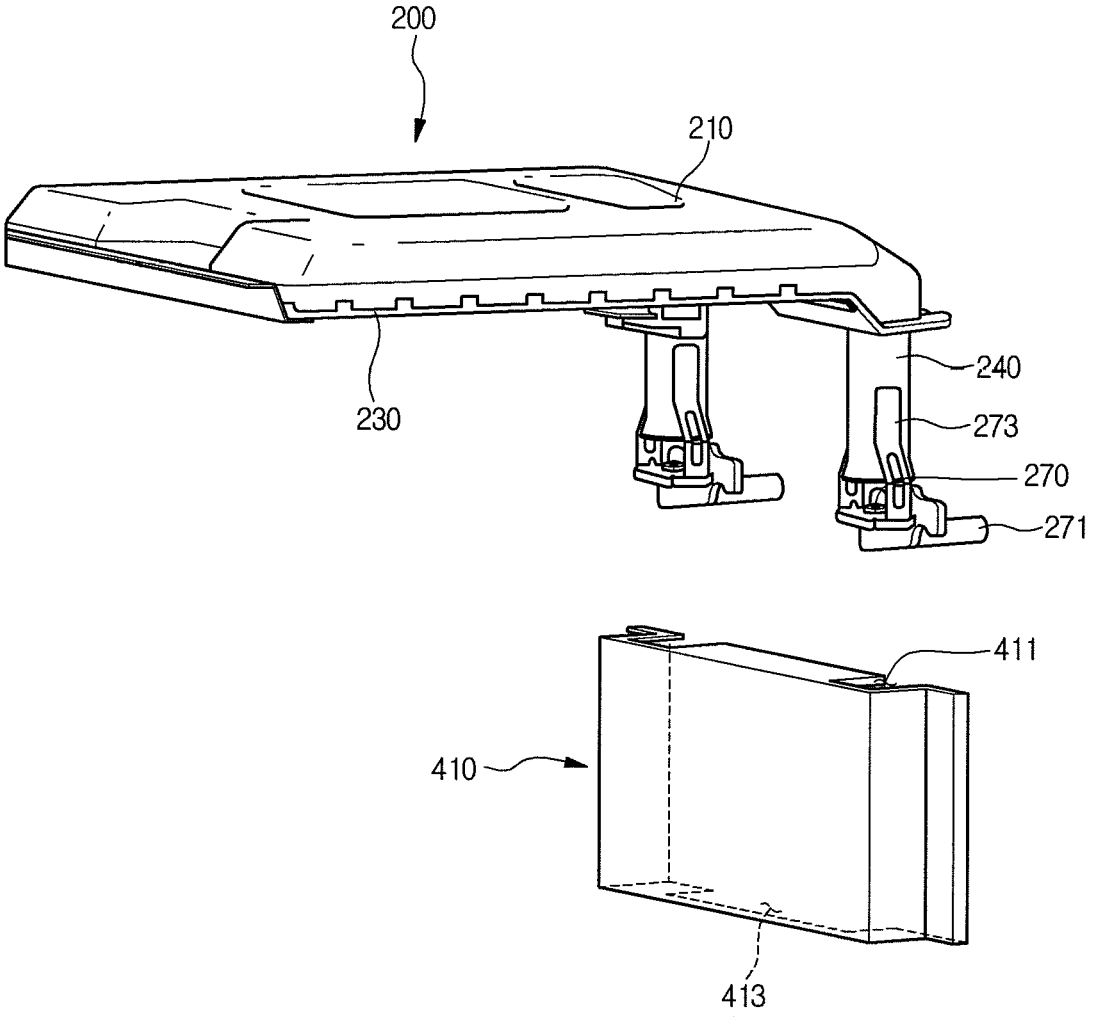
FIG. 3 is an exploded perspective view illustrating main parts of the cooker of the first embodiment.
Figure 4:
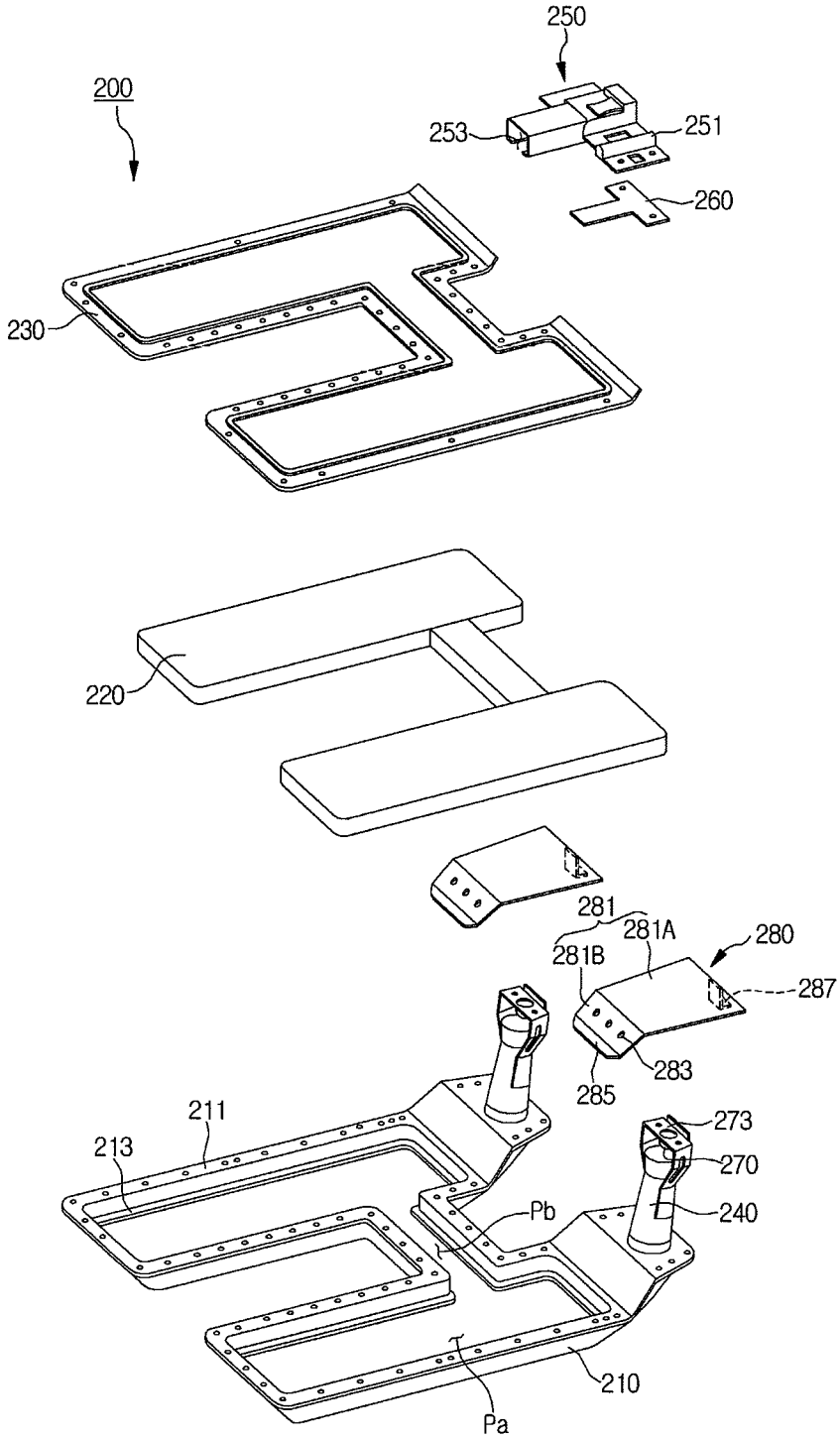
FIG. 4 is an exploded perspective view illustrating an upper broil burner according to the first embodiment.
Figure 5:
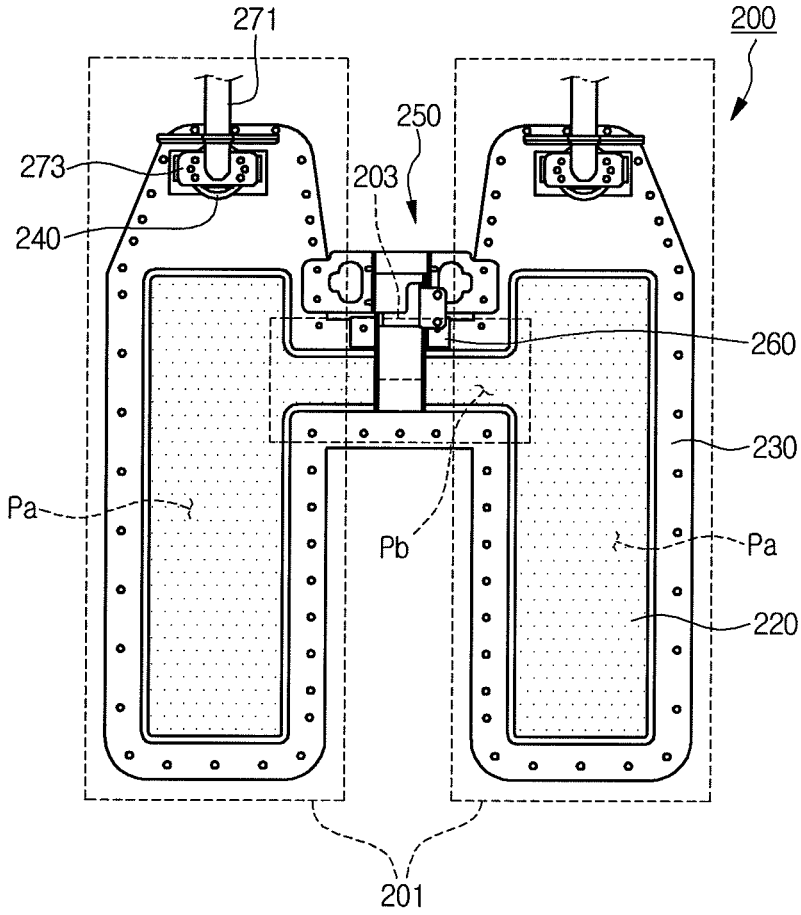
FIG. 5 is a plan view illustrating the upper broil burner according to the first embodiment.

FIG. 1 is a perspective view illustrating a cooker according to a first embodiment; FIG. 2 is a vertical sectional view illustrating main parts of the cooker of the first embodiment; FIG. 3 is an exploded perspective view illustrating main parts of the cooker of the first embodiment; FIG. 4 is an exploded perspective view illustrating an upper broil burner according to the first embodiment; and FIG. 5 is a plan view illustrating the upper broil burner according to the first embodiment.

Referring to FIGS. 1 to 3, the cooker includes a casing 10 forming the exterior of the cooker. The casing 10 has an approximately hexahedral shape with front openings. A top plate 11 is disposed on the topside of the casing 10. A rear end part of the top plate 11 is bent upward at a preset angle, for example, a right angle. Side panels 13 are disposed on both sides of the casing 10, and a back cover 15 is disposed on the backside of the casing 10. A bottom plate 17 is disposed on the bottom side of the casing 10. Intake inlets (not shown) are formed in both lateral ends of the bottom plate 17 so that air can be drawn into the casing 10.

A flow passage P is formed in the casing 10. Air sucked into the casing 10 through the intake inlets is guided along the flow passage P. The flow passage P may be formed between the back cover 15 and rear sides of upper and lower cavity parts 100 and 41, which will be described later. In addition, the flow passage P may be formed between the side panels 13 and both sides of the upper and lower cavity parts 100 and 41.

A cooktop 20, an upper oven 30, a lower oven 40, and a control part 50 are provided on or in the casing 10. The cooktop 20 is disposed on the topside of the casing 10. The upper oven 30 and the lower oven 40 are disposed in the casing 10. The control part 50 is disposed on a rear end of the topside of the casing 10.

In more detail, the cooktop 20 includes a plurality of cooktop burners 21. The cooktop burners 21 are disposed on the topside of the casing 10. That is, the cooktop burners 21 are disposed on the topside of the top plate 11. As the mixture gas discharged through the cooktop burners 21 is combusted, containers in which foods are contained may be heated by flames generated as a result of the combustion.

The upper oven 30 is disposed in the casing 10 under the cooktop 20. The upper oven 30 includes the upper cavity part 100 in which an upper oven chamber 101 is formed, a burner cover 150 disposed on the bottom side of the upper cavity part 100, an upper door 160 used to selectively open and close the upper oven chamber 101, an upper heating source configured to heat the inside of the upper oven chamber 101 for cooking food, and an upper exhaust duct 510 through which exhaust gas is discharged to the outside of the upper oven chamber 101. Herein, the term exhaust gas is used to indicate a gaseous matter such as gas generated as a result of combustion, steam, smoke, fumes, and a remaining air-gas mixture.

The upper cavity part 100 has an approximately hexahedral shape with an opened front side. The upper cavity part 100 may be disposed in the casing 10 under the top plate 11. The topside, bottom side, rear side, and both lateral sides of the upper cavity part 100 are formed by an upper plate 110, a base plate 120, a rear plate 130, and side plates 140, respectively.

An upper exhaust outlet 111 is formed in the upper plate 110. Exhaust gas is discharged from the upper oven chamber 101 through the upper exhaust outlet 111. The upper exhaust outlet 111 may be formed by cutting a portion of the upper plate 110.

Heat supply openings 121 are formed in the base plate 120. High-temperature air is supplied from a burner chamber 151, which will be described later, to the upper oven chamber 101 through the heat supply openings 121. The heat supply openings 121 are formed in both lateral end parts of the base plate 120. The heat supply openings 121 may extend in a front-to-rear direction. In addition, secondary air is supplied to the upper broil burner 200, which will be described later, substantially through the heat supply openings 121. Thus, the heat supply openings 121 may be referred to as secondary air supply openings.

Air supply openings 123 are formed in the base plate 120. The air supply openings 123 may be formed by cutting a portion of a rear end part of the base plate 120. Air is supplied from the burner chamber 151 to the upper broil burner 200 through the air supply openings 123. Generally, primary air is supplied through the air supply openings 123 to the upper broil burner 200. Thus, the air supply openings 123 may be referred to as primary air supply openings.

In this embodiment, the base plate 120 is formed as a separate part and is fixed to the upper cavity part 100. That is, in this embodiment, the upper cavity part 100 has a polyhedral shape with opened front and bottom sides. The bottom side of the upper cavity part 100 is formed by the base plate 120 fixed to the upper cavity part 100. However, it is understood that the base plate 120 and the upper cavity part 100 may be formed in one piece.

The burner cover 150 defines the base plate 120 and the burner chamber 151. An upper bake burner 300, which will be described later, is disposed in the burner chamber 151. The burner cover 150 is disposed on the bottom side of the upper cavity part 100 (that is, on the base plate 120) so as to cover the air supply openings 123. Generally, the upper oven chamber 101 and the burner chamber 151 communicate with each other through the air supply openings 123. In addition, a plurality of air supply holes 153 are formed in the burner cover 150. Air is supplied from the inside of the casing 10 to the burner chamber 151 through the air supply holes 153. That is, some of the air sucked into the casing 10 through the intake inlets is supplied to the burner chamber 151 through the air supply holes 153.

The upper heating source includes the upper broil burner 200 and the upper bake burner 300. The upper broil burner 200 heats food disposed in the upper oven chamber 101 by radiation. The upper bake burner 300 heats air supplied into the upper cavity part 100. In this embodiment, the upper broil burner 200 and the upper bake burner 300 may be alternately operated. That is, in the upper oven chamber 101, food may be cooked by the upper broil burner 200 or the upper bake burner 300.

The upper broil burner 200 is disposed in an upper region of the upper oven chamber 101. In this embodiment, an infrared burner may be used as the upper broil burner 200. In more detail, the upper broil burner 200 includes a burner port 210, a combustion member 220, a port cover 230, mixing tubes 240, an ignition unit 250, and a gas guide member 260.

The burner port 210 has an approximately polyhedral shape with an opened bottom side. A mixture of gas and air is supplied into the burner port 210. A receiving end 211 is formed along a lateral inner surface of the burner port 210. Edges of the top surface of the combustion member 220 are placed on the receiving end 211. A support flange 213 is provided on the bottom surface of the burner port 210. Generally, the support flange 213 is provided on the circumferential bottom end of the burner port 210. The edges of the top surface of the port cover 230 are supported on the support flange 213. A plurality of flow passages are formed in the burner port 210. A specific structure of the burner port 210 and the flow passages will be described later.

The combustion member 220 is disposed on the bottom surface of the burner port 210. Generally, the top-surface edges of the combustion member 220 are placed on the receiving ends 211. The combustion member 220 may be formed of a porous material such as a ceramic material. The mixture gas supplied into the burner port 210 is burned on the surface of the combustion member 220 as the mixture gas passes through the combustion member 220. Generally, the combustion member 220 blocks a flow passage formed in the burner port 210. While the mixture gas is burned on the surface of the combustion member 220 as described above, secondary air is supplied through the heat supply openings 121.

The port cover 230 fixes the combustion member 220 disposed on the bottom surface of the burner port 210. For this, the port cover 230 is fixed to the burner port 210 after the combustion member 220 is placed on the bottom surface of the burner port 210. The port cover 230 may be fixed to the burner port 210 by bringing the top surface of the port cover 230 into contact with the bottom surface of the support flange 213 and securing the port cover 230 to the support flange 213 by welding or using fasteners.

Gas and air are mixed in the mixing tubes 240 and then supplied to the burner port 210. In this embodiment, two mixing tubes 240 extend downward from the bottom rear end of the burner port 210. The mixing tubes 240 may be fixed to the bottom surface of the burner port 210 by welding or using fasteners. In a state where the upper broil burner 200 is disposed in the upper oven chamber 101, lower ends of the mixing tubes 240 are disposed close to the air supply openings 123. That is, primary air is supplied to the mixing tubes 240 from the air supply openings 123.

The ignition unit 250 ignites the mixture gas flowing on the surface of the combustion member 220. The ignition unit 250 is fixed to a side of the port cover 230. The ignition unit 250 is spaced a predetermined distance from the combustion member 220 in a downward direction such that the combustion member 220 is located between the burner port 210 and the ignition unit 250.

In this embodiment, the ignition unit 250 includes a fixation holder 251 and a heating unit 253. The fixation holder 251 is fixed to a side of the burner port 210 for fixing the heating unit 253. For example, the fixation holder 251 may be fixed to the burner port 210 by welding. The heating unit 253 is heated to a higher temperature for igniting the mixture gas discharged through the combustion member 220. In a state where the heating unit 253 is fixed to the fixation holder 251, at least a portion of the heating unit 253 is overlapped with the combustion member 220.

The mixture gas discharged through a predetermined region of the combustion member 220 is guided to the ignition unit 250 by the gas guide member 260. The gas guide member 260 is fixed to a position of the burner port 210 close to the ignition unit 250. Generally, the gas guide member 260 is disposed among the combustion member 220, the ignition unit 250, and the heating unit 253. Thus, the gas guide member 260 may be overlapped with the heating unit 253 in a direction perpendicular to the surface of the combustion member 220. At this time, the gas guide member 260 may be overlapped with a portion of the heating unit 253 close to the fixation holder 251. In other words, when the gas guide member 260 and the heating unit 253 are projected on the surface of the combustion member 220 in a direction perpendicular to the combustion member 220, the projection of the gas guide member 260 may be within the projection of the heating unit 253. Therefore, the mixture gas discharged through a portion of the combustion member 220 corresponding to the projection of the gas guide member 260 may not flow directly to the heating unit 253 but flow to the heating unit 253 after being guided by the gas guide member 260. That is, the mixture gas discharged through the combustion member 220 may be guided by the gas guide member 260 toward a portion of the heating unit 253 which is not overlapped with the gas guide member 260 in a direction perpendicular to the surface of the combustion member 220.

Gas is injected into the mixing tubes 240 through nozzles 270. For this, the nozzles 270 are coupled to gas pipes 271 which extend into the upper oven chamber 101 through the rear plate 130. In this embodiment, the nozzles 270 are fixed to the mixing tubes 240 by nozzle holders 273. The nozzles 270 are spaced a predetermined distance from the bottom ends of the mixing tubes 240. Gas injected through the nozzles 270 is supplied into the mixing tubes 240 together with primary air supplied along the air supply openings 123.

Referring to FIGS. 4 and 5, in this embodiment, the burner port 210 has a polyhedral shape with an H-shaped cross section. A plurality of flow passages are formed in the burner port 210 for allowing flows of the mixture gas. The flow passages include two combustion flow passages Pa and an ignition flow passage Pb.

Specifically, the combustion flow passages Pa are long and parallel with each other. The combustion flow passages Pa are spaced apart from each other in a direction perpendicular to the lengths of the combustion flow passages Pa. The mixture gas is supplied to the insides of the combustion flow passages Pa so that the mixture gas can be burned on the surface of the combustion member 220 to generate heat for cooking food. The same amounts of the mixture gas may be supplied to the combustion flow passages Pa, respectively. Of course, the amounts of the mixture gas supplied to the combustion flow passages Pa may be somewhat different. However, although the amounts of the mixture gas supplied to the combustion flow passages Pa may be somewhat different, the difference should not be so great that the cooking efficiency of the upper oven chamber 101 is affected. The rear ends of the combustion flow passages Pa communicate with the mixing tubes 240. Therefore, the mixture gas supplied from the mixing tubes 240 may flow along the lengths of the combustion flow passages Pa.

The mixture gas is ignited while flowing in the ignition flow passage Pb. The mixture gas flows from the combustion flow passages Pa to the ignition flow passage Pb. The ignition flow passage Pb is elongated in a direction perpendicular to the lengths of the combustion flow passages Pa. In other words, both ends of the ignition flow passage Pb communicate with the combustion flow passages Pa, respectively. Specifically, both ends of the ignition flow passage Pb are connected to lateral sides of the combustion flow passages Pa at positions close to the rear ends of the combustion flow passages Pa to which the mixing tubes 240 are connected. In other words, both ends of the ignition flow passage Pb are connected to upstream sides of the combustion flow passages Pa in the flow direction of the mixture gas.

The combustion flow passages Pa and the ignition flow passage Pb may be distinguished by whether the mixture gas is directly ignited or not. That is, the mixture gas flowing in the ignition flow passage Pb is directly ignited by the ignition unit 250. However, the mixture gas flowing in the combustion flow passages Pa is ignited (burned) as the mixture gas flowing in the ignition flow passage Pb is ignited by the ignition unit 250 and a flame propagates. That is, the inner flow passages of the burner port 210 are classified into the combustion flow passages Pa and the ignition flow passage Pb according to whether the mixture gas is directly ignited or not. Therefore, although some of the thermal energy necessary for cooking food in the upper oven chamber 101 is generated by combustion of the mixture gas in the ignition flow passage Pb, most of thermal energy necessary for cooking food in the upper oven chamber 101 may be generated by combustion of the mixture gas in the combustion flow passages Pa.

In this embodiment, the cross sectional area of the ignition flow passage Pb is smaller than the sum of the cross sectional areas of the combustion flow passages Pa. Therefore, the sum of areas of portions of the combustion member 220 corresponding to the combustion flow passages Pa is greater than the area of a portion of the combustion member 220 corresponding to the ignition flow passage Pb. Generally, the mixture gas is burned on the surface of the combustion member 220. Thermal energy generating from portions of the upper broil burner 200 corresponding to the combustion flow passages Pa may be greater than thermal energy generating from the other portion of the upper broil burner 200 corresponding to the ignition flow passage Pb.

In this embodiment, the combustion flow passages Pa and the ignition flow passage Pb may be symmetric with respect to an imaginary plane by which the upper oven chamber 101 is divided into left and right parts. However, the reference symmetry plane of the combustion flow passages Pa and the ignition flow passage Pb is not limited to the imaginary plane by which the upper oven chamber 101 is divided into left and right parts.

The ignition unit 250 is disposed at a side of the burner port 210 close to the ignition flow passage Pb. In this embodiment, the ignition unit 250 is heated to a high temperature to ignite the mixture gas discharged through the combustion member 220. For this, at least a portion of the ignition unit 250 may be overlapped with a portion of the combustion member 220 corresponding to the ignition flow passage Pb.

As described above, generally, the combustion flow passages Pa and the ignition flow passage Pb are shield by the combustion member 220. Thus, in the following description, portions of the burner port 210 corresponding to the combustion flow passages Pa, and portions of the combustion member 220 shielding the portions of the burner port 210 will be referred to as combustion compartments 201. In addition, a portion of the burner port 210 corresponding to the ignition flow passage Pb, and a portion of the combustion member 220 shielding the portion of the burner port 210 will be referred to as an ignition compartment 203. It is understood that the ignition compartment also performs combustion such that the combustion compartments 201 and ignition compartment 203 could be collectively referred to as combustion compartments; however, for ease of description, separate designations of combustion compartments 201 and ignition compartment 203 will be used without being limitative thereof.

In this embodiment, the combustion member 220 includes a plurality of parts. For example, the combustion member 220 may be include parts corresponding to the combustion flow passages Pa and the ignition flow passage Pb. In this case, the combustion member 220 may be easily machined, and the strength of the combustion member 220 may be maintained although the size of the combustion member 220 is large. The area of a contact surface between the combustion member 220 and the burner port 210 is greater than the area of contact surfaces between the parts of the combustion member 220. In other words, 50% or more of the edge of the combustion member 220 is in contact with the burner port 210. In this case, the combustion member 220 which is heated by combustion of the mixture gas on the surface of the upper broil burner 200 may be sufficiently supported by the burner port 210 and the port cover 230.

In this embodiment, distribution members 280 are disposed in the combustion flow passages Pa. Some of the mixture gas flowing in the combustion flow passages Pa is guided to the ignition flow passage Pb by the distribution members 280. In other words, the distribution members 280 interferes with the flow of the mixture gas flowing in the combustion flow passages Pa so that some of the mixture gas can flow to the ignition flow passage Pb. The distribution members 280 are disposed close to the rear ends of the combustion flow passages Pa to which the mixing tubes 240 are connected. Generally, the distribution members 280 divide the combustion flow passages Pa into regions communicating with the ignition flow passage Pb and the remaining regions. In other words, each of the combustion flow passages Pa is divided into two regions by the distribution member 280, and only one of the two regions communicate with the ignition flow passage Pb. The distribution members 280 include interference parts 281, gas flow holes 283, and fixation parts.

Specifically, the interference parts 281 interfere with the flow of some of the mixture gas flowing in the combustion flow passages Pa. That is, since flows of the mixture gas are interfered with by the interference parts 281, some of the mixture gas flowing through the combustion flow passages Pa can flow to the ignition flow passage Pb.

The interference parts 281 extend in a direction along the lengths of the combustion flow passages Pa. The interference parts 281 include horizontal surfaces 281A and oblique surfaces 281B. The horizontal surfaces 281A extend in a direction parallel with an imaginary plane (hereinafter referred as a reference plane) along which the mixture gas flows in the combustion flow passages Pa. The oblique surfaces 281B extend from the front ends of the horizontal surfaces 281A at a predetermined angle with the reference plane. The horizontal surfaces 281A are in contact with or close to the combustion member 220, and the upper ends (front ends) of the oblique surfaces 281B are in contact with or close to the inner surface of the burner port 210. Generally, each of the combustion flow passages Pa is divided into two regions by the interference parts 281. Thus, the interference parts 281 may be referred to as compartment parts. The oblique surfaces 281B are upwardly sloped at an angle with the reference surface. Therefore, the cross sectional areas of the combustion flow passages Pa may be gradually decreased by the interference parts 281.

The mixture gas supplied by the mixing tubes 240 in an upward direction flows in the combustion flow passages Pa in a forward direction. That is, flows of the mixture gas may be faster at upper regions of the combustion flow passages Pa than at lower regions of the combustion flow passages Pa.

Therefore, in the combustion flow passages Pa, the interference parts 281 may be sloped from regions where flows of the mixture gas are relatively slow to regions where flows of the mixture gas are relatively fast.

The gas flow holes 283 are formed in the interference parts 281. Specifically, the gas flow holes 283 are formed in the oblique surfaces 281B. The mixture gas supplied from the mixing tubes 240 to the combustion flow passages Pa may flow through the gas flow holes 283 without changing its flow direction. In other words, the mixture gas supplied from the mixing tubes 240 may pass through the gas flow holes 283 and flow in the combustion flow passages Pa except for some of the mixture gas that is guided to the ignition flow passage Pb. Generally, two regions of the combustion flow passages Pa divided by the interference parts 281 are connected through the gas flow holes 283. Thus, the gas flow holes 283 may be referred to as communication holes.

The fixation parts of the distribution members 280 are fixed to the burner port 210. The fixation parts include first and second fixation flanges 285 and 287. The first fixation flanges 285 extends horizontally from the upper ends (front ends) of the interference parts 281. The second fixation flanges 287 extend from the lower ends (rear ends) of the interference parts 281. Each of the second fixation flanges 287 has an L-shaped vertical section. The first and second fixation flanges 285 and 287 are fixed to the inner surface of the burner port 210. For example, the first and second fixation flanges 285 and 287 may be fixed to the burner port 210 by welding. The second fixation flanges 287 are narrower than the upper and lower ends of the interference parts 281. In a state where the first and second fixation flanges 285 and 287, the bottoms surfaces of the interference parts 281 may be spaced a predetermined distance from the combustion member 220. That is, the lower ends of the distribution members 280 may be spaced apart from the top surface of the combustion member 220.

In this embodiment, lateral ends of the distribution members 280 (generally, lateral ends of the interference parts 281) may be spaced a predetermined distance from inner surfaces of the burner port 210 forming lateral surfaces of the combustion flow passages Pa. In other words, predetermined gaps may be formed between the inner surfaces of the burner port 210 and the lateral ends of the interference parts 281. As a result, a desired amount of the mixture gas may flow through the combustion flow passages Pa. Thus, in the case where a desired amount of the mixture gas can flow in the combustion flow passages Pa according to the size and number of the gas flow holes 283, the lower ends and lateral ends of the interference parts 281 may be in contact with the top surface of the combustion member 220 and the inner surfaces of the burner port 210.

Referring again to FIGS. 1 to 3, the upper bake burner 300 is disposed in the burner chamber 151. A general gas burner including a plurality of flame holes may be used as the upper bake burner 300. Generally, the upper bake burner 300 may heat air in the burner chamber 151.

In this embodiment, a barrier member 410 is disposed in the upper oven chamber 101. As a result of the barrier member 410, air and gas to be mixed and supplied into the upper broil burner 200 can be prevented from being heated by a high-temperature atmosphere in the upper oven chamber 101. That is, the barrier member 410 may block flows of air from the inside of the upper oven chamber 101 into the mixing tubes 240. For this, the barrier member 410 divides the inside of the upper oven chamber 101 into a region for cooking a food and a region for supplying air and gas. Therefore, the barrier member 410 may be referred to as a compartment member. In the following description, one of the inside regions of the upper oven chamber 101 defined by the barrier member 410 will be referred to as a cooking region, and the other will be referred to as a mixing region. In the cooking region, food may be cooked, and in the mixing region, air and gas may be supplied. The mixing tubes 240 and the nozzles 270 are disposed substantially in the mixing region.

In this embodiment, the barrier member 410 has a polyhedral shape with an opened rear side. In addition, the barrier member 410 is fixed to the front side of the rear plate 130. The topside of the barrier member 410 is disposed on the bottom side of the upper broil burner 200, that is, the bottom side of the port cover 230. The bottom side of the barrier member 410 is disposed on the topside of the base plate 120. Communication openings 411 are formed in the top surface of the barrier member 410, and a communication opening 413 is formed in the bottom surface of the barrier member 410.

When the barrier member 410 is installed, the mixing tubes 240 are disposed through the communication openings 411. The communication opening 413 communicates with the heat supply openings 121. Therefore, a space defined by the front side of the rear plate 130 and the inner surface of the barrier member 410 is isolated from the upper oven chamber 101 where food may be cooked, but the space communicates with the burner chamber 151 through the air supply openings 123. The mixing tubes 240 are disposed in the space between the rear plate 130 and the barrier member 410.

Exhaust gas of the upper oven chamber 101 is discharged to the outside of the casing 10 through the upper exhaust duct 510. In other words, exhaust gas of the upper oven chamber 510 flows along the upper exhaust duct 510 and is then discharged to the outside of the casing 10. The lower end of the upper exhaust duct 510 communicates with the upper exhaust outlet 111, and the upper end of the upper exhaust duct 510 communicates with an exhaust slot 53.

The lower oven 40 is disposed in the casing 10 under the upper oven 30. That is, the upper oven 30 and the lower oven 40 are arranged in a vertically stacked manner. The lower oven 40 includes the lower cavity part 41 in which a lower oven chamber 42 is formed, a burner cover 44 disposed on the bottom side of the lower cavity part 41, a lower door 45 used to selectively open and close the lower oven chamber 42, a lower heating source configured to heat the inside of the lower oven chamber 42 for cooking food; and a lower exhaust duct 49 through which exhaust gas is discharged to the outside of the lower oven chamber 42.

Generally, the lower cavity part 41 is disposed under the upper cavity part 100. Like the upper cavity part 100, the lower cavity part 41 has a hexahedral shape with an opened front side. In this embodiment, the height of the lower cavity part 41 is greater than that of the upper cavity part 100. A lower exhaust outlet 43 is formed in a rear surface of the lower cavity part 41. Exhaust gas is discharged from the lower oven chamber 42 through the lower exhaust outlet 43.

The lower heating source may include a lower bake burner 47 and a convection device 48. The lower bake burner 47 and the convection device 48 are identical to those of a related-art oven. Thus, detailed descriptions thereof will be omitted.

Exhaust gas of the lower oven chamber 42 is discharged to the outside of the casing 10 through the lower exhaust duct 49. For this, the lower end of the lower exhaust duct 49 is connected to the lower exhaust outlet 43. In addition, the upper end of the lower exhaust duct 49 is connected to a side of the upper exhaust duct 510. Therefore, exhaust gas of the lower oven chamber 42 may be discharged to the outside of the casing 10 sequentially through the lower exhaust duct 49, the upper exhaust duct 510, and the exhaust slot 53.

The control part 50 is disposed at the rear side of the top plate 11. That is, the control part 50 is disposed at the rear end of the topside of the casing 10. The control part 50 is used to receive commands or signals for operating the upper oven 30 and the lower oven 40 and display operational states of the upper oven 30 and the lower oven 40.

The front and lateral sides of the control part 50 are formed by a control panel 51. The front lower end of the control panel 51 is spaced a preset distance from an upper end of the top plate 11. Thus, a predetermined gap is formed between the upper end of the top plate 11 and the front lower end of the control panel 51. In the following description, the gap between the top plate 11 and the control panel 51 will be referred to as the exhaust slot 53. Exhaust gas of the upper oven chamber 101 and lower oven chamber 42 is discharged to the outside of the casing 10 through the exhaust slot 53.

Figure 6:
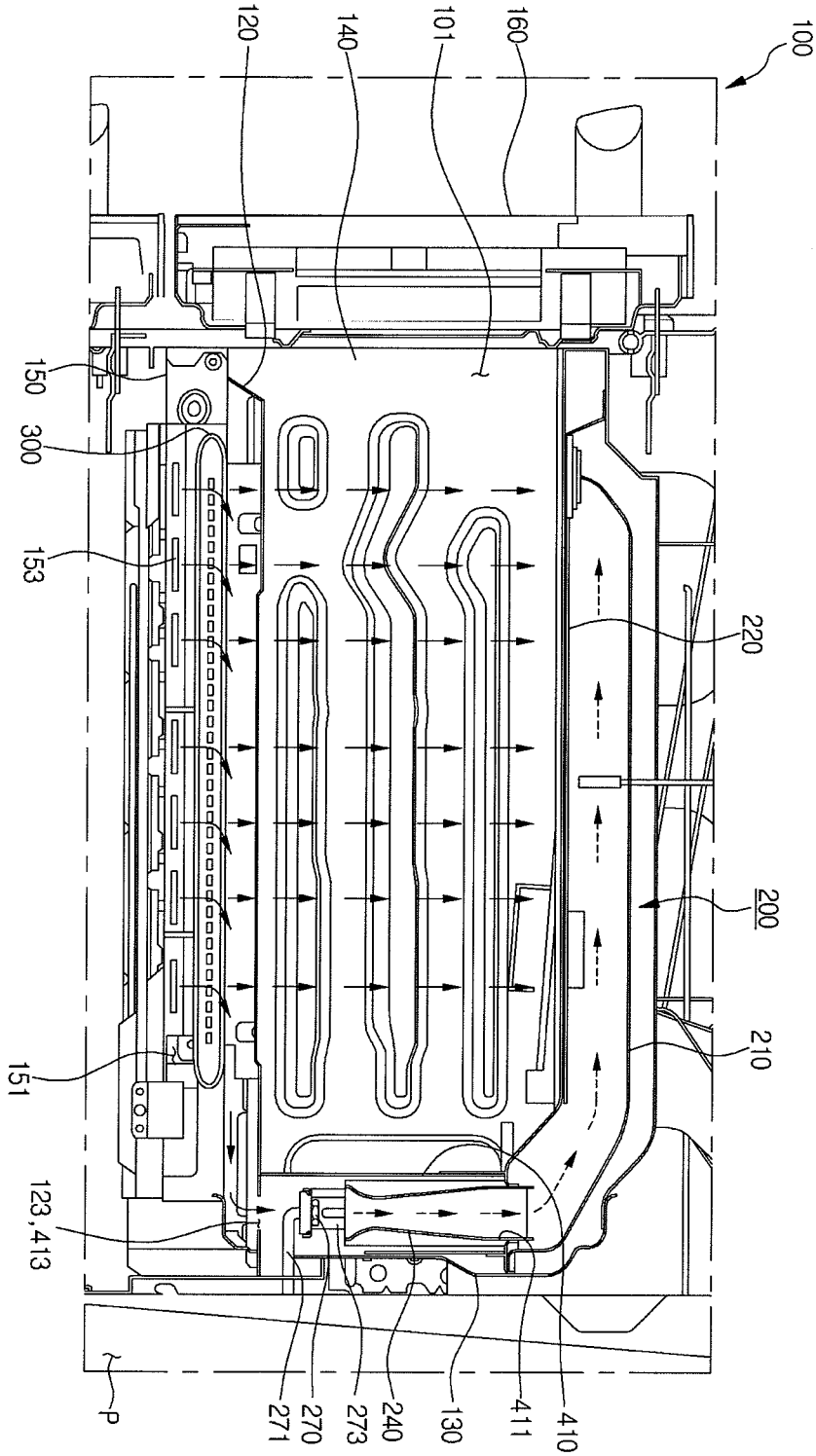
FIG. 6 is a vertical sectional view illustrating flows of air flows in an upper oven of the cooker according to the first embodiment.

Hereinafter, an exemplary operation of the cooker of the first embodiment will be described in detail with reference to the accompanying drawings. FIG. 6 is a vertical sectional view illustrating flows of air flows in an upper oven of the cooker according to the first embodiment, and FIG. 7 is a cross sectional view illustrating flows of exhaust gas in the upper broil burner 200 of the cooker according to the first embodiment.

Food can be cooked in the upper oven chamber 101 by using the upper broil burner 200 but not using the upper bake burner 300. In the operation of the upper broil burner 200, the mixture gas is burned on the surface of the combustion member 220, and thus the food disposed in the upper oven chamber 101 can be cooked by heat from the burning the mixture gas.

Referring to FIG. 6, air necessary for combustion of the mixture gas in the upper broil burner 200 is sucked into the casing 10 through the intake inlets (not shown). Some of air sucked into the casing 10 is supplied as primary air into the burner chamber 151 through the air supply holes 153. Then, the primary air is supplied from the burner chamber 151 to the mixing tubes 240 through the air supply openings 123. At this time, the primary air is supplied from the air supply openings 123 to the mixing tubes 240 together with gas injected through the nozzles 270. The gas and the primary air supplied into the mixing tubes 240 as described above are mixed with each other while flowing along the mixing tubes 240, and are supplied into the upper broil burner 200 in the form of the mixture gas.

Figure 7:
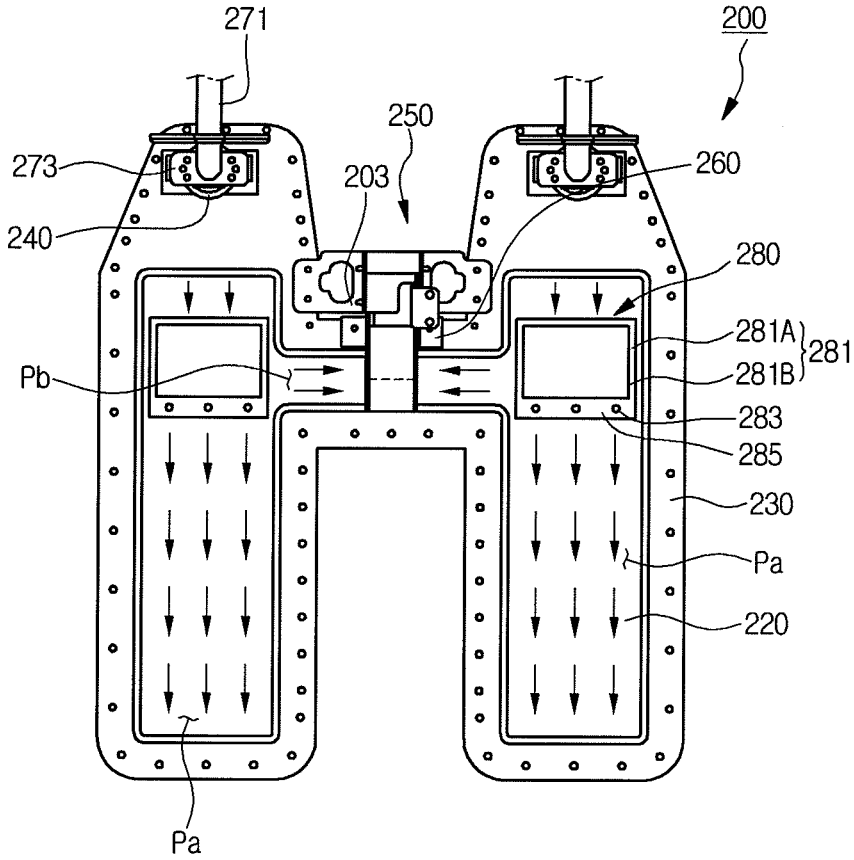
FIG. 7 is a cross sectional view illustrating flows of exhaust gas in the upper broil burner of the cooker according to the first embodiment.

Referring to FIG. 7, the mixture gas supplied into the upper broil burner 200 through the mixing tubes 240 flows in the flow passages of the burner port 210. In more detail, the mixture gas is supplied from the mixing tubes 240 to the combustion flow passages Pa. In the combustion flow passages Pa, the mixture gas makes interference with the distribution members 280, and thus some of the mixture gas flows into the ignition flow passage Pb. The rest of the mixture gas flows continuously in the combustion flow passages Pa after passing through the gas flow holes 283 and between the burner port 210 and the distribution members 280.

While flowing in the combustion flow passages Pa and the ignition flow passage Pb, the mixture gas is discharged through the surface of the combustion member 220. Some of the mixture gas discharged through the combustion member 220 while flowing in the ignition flow passage Pb is ignited by the ignition unit 250. Then, a flame propagates to the rest of the mixture gas which is discharged through the combustion member 220 while flowing in the combustion flow passages Pa. In this way, the mixture gas can be burned over the entire surface of the combustion member 220. At this time, the rest of the air sucked in the burner chamber 151 is supplied as secondary air into the upper oven chamber 101 through the heat supply openings 121.

As described above, in this embodiment, food is cooked in the upper oven chamber 101 by burning the mixture gas substantially in the two combustion compartments 201 of the upper broil burner 200. In addition, when the mixture gas guided to the ignition compartment 203 by the distribution members 280 is ignited, a flame propagates over the entire surface of the combustion member 220. Thus, the mixture gas can be burned over the entire surface of the combustion member 220.

Therefore, according to this embodiment, food can be uniformly cooked in the upper oven chamber 101 by heat generated from combustion of the mixture gas in the plurality of combustion compartments 201. In addition, according to this embodiment, the mixture gas can be ignited at one ignition compartment 203 by using one ignition unit 250, and a flame can propagate to the plurality of combustion compartments 201. That is, the mixture gas can be burned at the plurality of combustion compartments 201 by using a simple structure.

Figure 8:
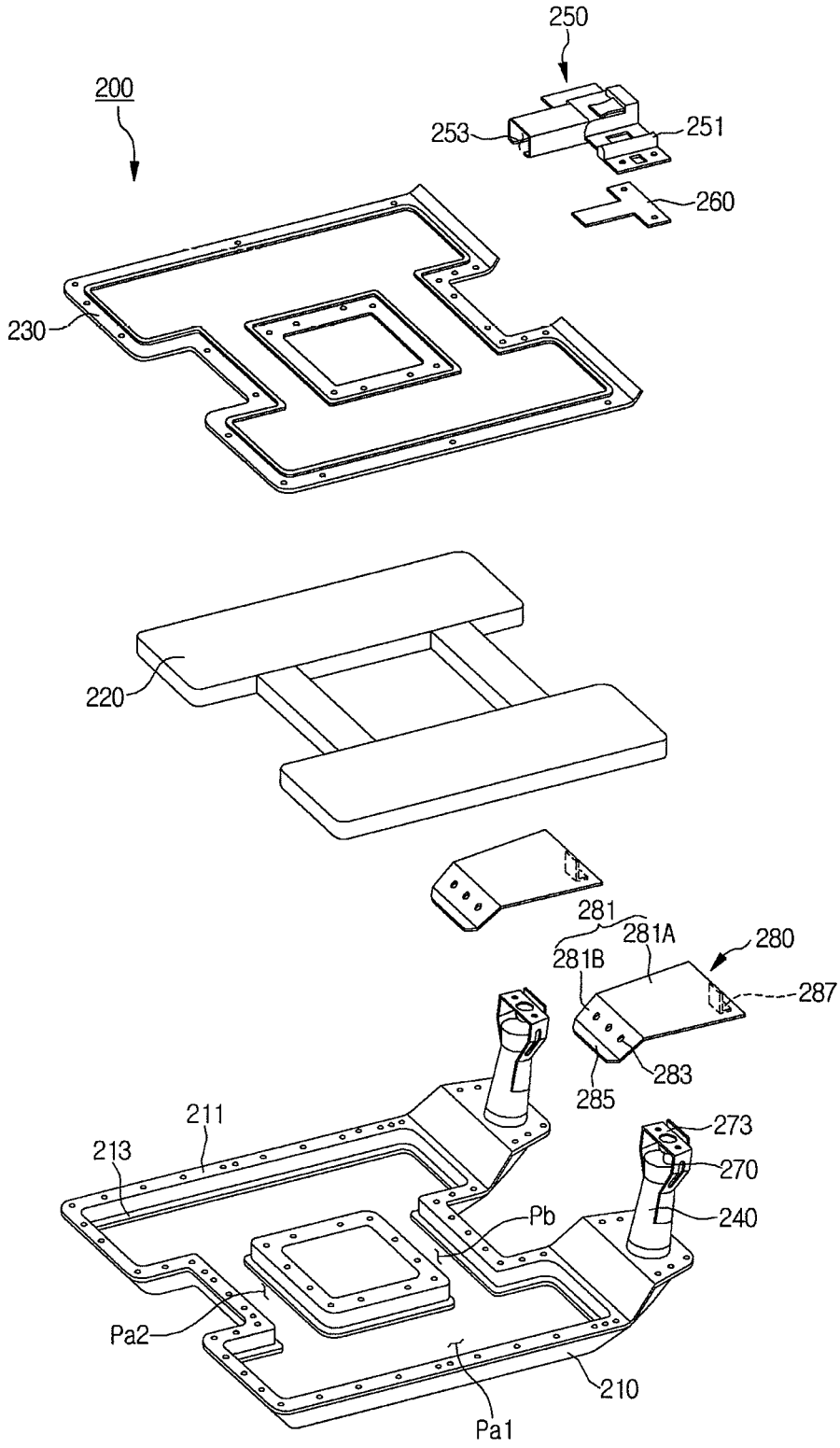
FIG. 8 is an exploded perspective view illustrating an upper broil burner according to a second embodiment.
Figure 9:
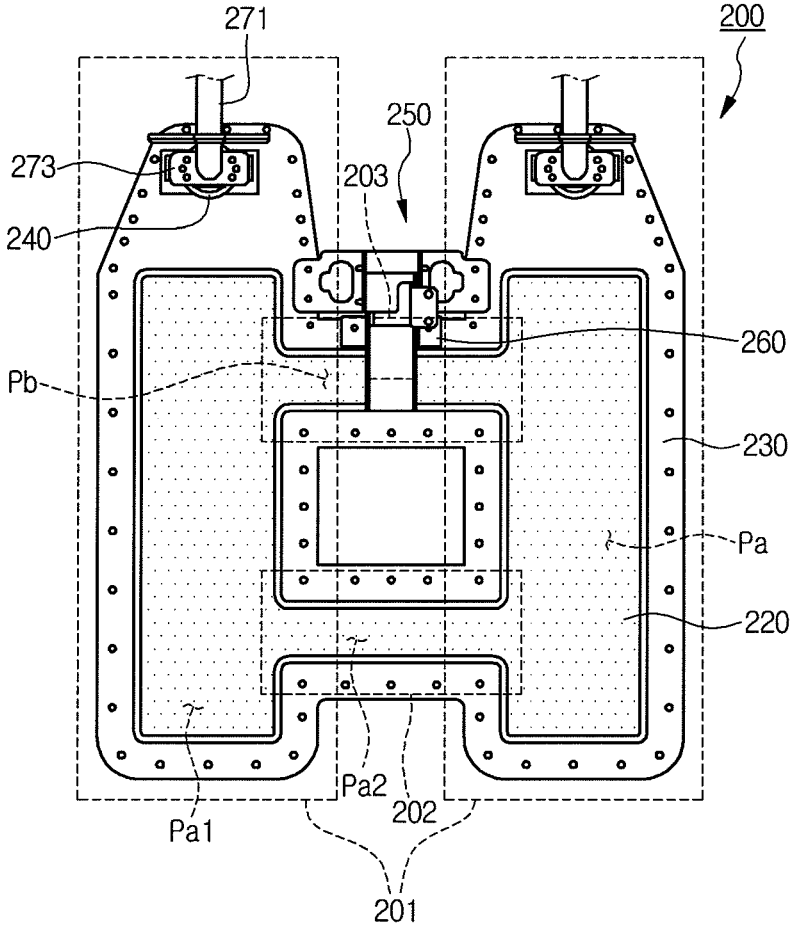
FIG. 9 is a plan view illustrating the upper broil burner according to the second embodiment.

Hereinafter, an explanation will be given of a cooker according to a second embodiment with reference to the accompanying drawings. FIG. 8 is an exploded perspective view illustrating an upper broil burner according to a second embodiment, and FIG. 9 is a plan view illustrating the upper broil burner according to the second embodiment. In the second embodiment, the same elements as those of the first embodiment will be denoted by the same reference numerals used in FIGS. 1 to 7, and detailed descriptions thereof will not be repeated.

Referring to FIG. 9, according to this embodiment, combustion flow passages Pa of a burner port 210 include first and second combustion flow passages Pa1 and Pa2. The first combustion flow passages Pa1 are substantially the same as the combustion flow passages Pa of the previous embodiment. That is, in this embodiment, the second combustion flow passage Pa2 is additionally provided as compared with the previous embodiment.

According to this embodiment, both ends of the second combustion flow passage Pa2 are connected to downstream sides of the first combustion flow passages Pa1 in the flow direction of the mixture gas in the first combustion flow passages Pa1. That is, both ends of the second combustion flow passage Pa2 are connected to sides of the first combustion flow passages Pa1 at positions close to front ends (downstream-side ends) of the first combustion flow passages Pa1 which are opposite to rear ends (upstream-side ends) of the first combustion flow passages Pa1. A ignition flow passage Pb is disposed close to the rear ends of the first combustion flow passages Pa1. Some of the mixture gas may flow from the first combustion flow passages Pa1 to the second combustion flow passage Pa2. The second combustion flow passage Pa2 may have substantially the same function as the first combustion flow passages Pa1. That is, when food is cooked in the upper oven chamber 101, the mixture gas may flow in the second combustion flow passage Pa2 for generating thermal energy necessary. Like in the first embodiment, portions of the burner port 210 corresponding to the first and second combustion flow passages Pa1 and Pa2, and portions of a combustion member 220 shielding the portions may be referred to as first and second combustion compartments 201 and 202.

Figure 10:
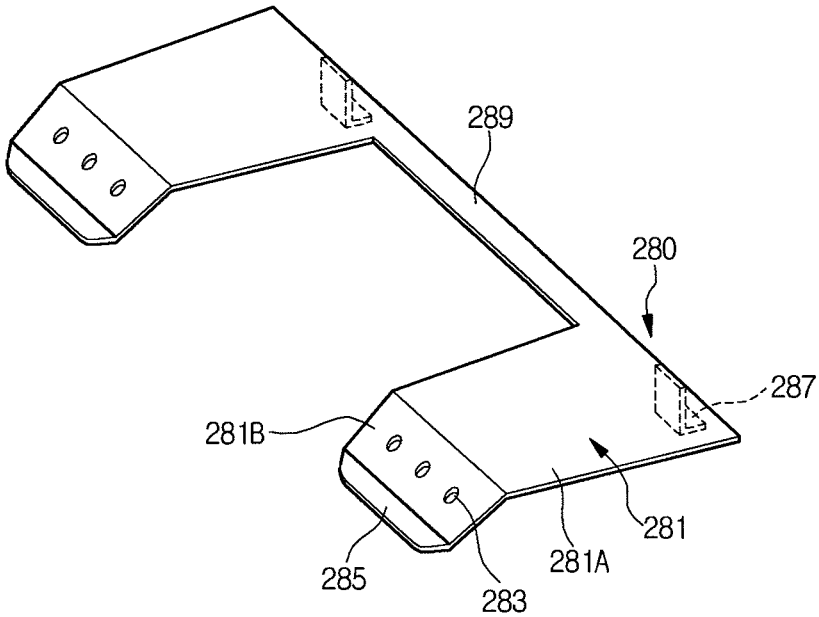
FIG. 10 is a perspective view illustrating a distribution member according to a third embodiment.

Hereinafter, an explanation will be given of a cooker according to a third embodiment with reference to the accompanying drawings. FIG. 10 is a perspective view illustrating a distribution member according to a third embodiment. In the third embodiment, the same elements as those of the first embodiment will be denoted by the same reference numerals used in FIGS. 1 to 7, and detailed descriptions thereof will not be repeated.

Referring to FIG. 10, in this embodiment, distribution members 280 are formed in one piece. For this, the distribution members 280 are connected through a connection rib 289. Specifically, both sides of the connection rib 289 are connected to mutually-facing end parts of the distribution members 280, respectively. In more detail, both ends of the connection rib 289 are connected to mutually-facing end parts of interference parts 281, respectively. In this embodiment, the distribution members 280 and the connection rib 289 are formed in one-piece.

Figure 11:
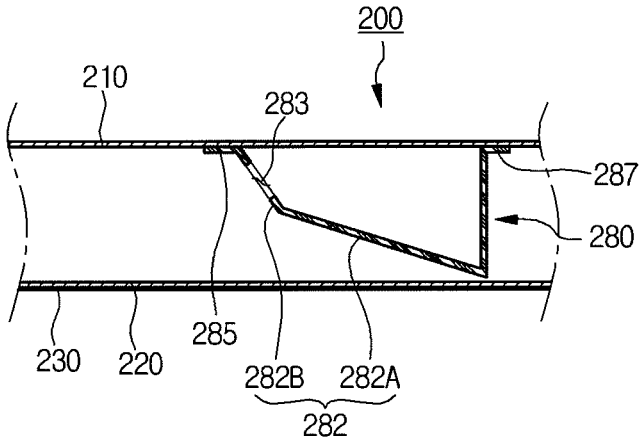
FIG. 11 is a vertical sectional view illustrating main parts of an upper broil burner of a cooker according to a fourth embodiment.

Hereinafter, an explanation will be given of a cooker according to a fourth embodiment with reference to the accompanying drawings. FIG. 11 is a vertical sectional view illustrating main parts of an upper broil burner of a cooker according to a fourth embodiment. In the fourth embodiment, the same elements as those of the first embodiment will be denoted by the same reference numerals used in FIGS. 1 to 7, and detailed descriptions thereof will not be repeated.

Referring to FIG. 11, an interference part 282 of a distribution member 280 includes first and second oblique surfaces 282A and 282B. The first oblique surface 282A is disposed at a lower end part of the interference part 282. The first oblique surface 282A is sloped upward at a predetermined angle with respect to an imaginary reference plane parallel with a flow direction of the mixture gas flowing in a combustion flow passage Pa. The second oblique surface 282B is sloped upward from the upper end of the first oblique surface 282A at a predetermined angle with respect to the reference plane. The predetermined angle between the first oblique surface 282A and the reference plane is smaller than the predetermined angle between the second oblique surface 282B and the reference plane. As a result of this structure, the mixture gas supplied from a mixing tube 240 to the combustion flow passage Pa may flow uniformly through the entire section of the combustion flow passage Pa. That is, as described above, since the mixing tube 240 extends downward from the combustion flow passage Pa in a direction perpendicular to the combustion flow passage Pa, when the mixture gas is supplied from the mixing tube 240 to the combustion flow passage Pa, the flow direction of the mixture gas is changed from vertical to horizontal. Therefore, when the mixture gas flows from the mixing tube 240 to the combustion flow passage Pa, the mixture gas flows a longer distance in an upper region than in a lower region of the combustion flow passage Pa. Thus, the flow velocity of the mixture gas is higher at an upper region than in a lower region of the cross section of the combustion flow passage Pa. In this embodiment, the second oblique surface 282B disposed in the upper region of the combustion flow passage Pa is sloped at a larger angle with the reference plane as compared with the first oblique surface 282A disposed in the lower region of the combustion flow passage Pa. Therefore, according to this embodiment, the first oblique surface 282A disposed in the lower region of the cross section of the combustion flow passage Pa may make a larger angle with the flow direction of the mixture gas in the combustion flow passage Pa than the second oblique surface 282B disposed in the upper region of the cross section of the combustion flow passage Pa. Therefore, flows of the mixture gas may be interfered with more severely by the second oblique surface 282B in the upper region of the cross section of the combustion flow passage Pa. This may reduce the difference between flowrates of the mixture gas in the upper and lower regions of the cross section of the combustion flow passage Pa.

Figure 12:
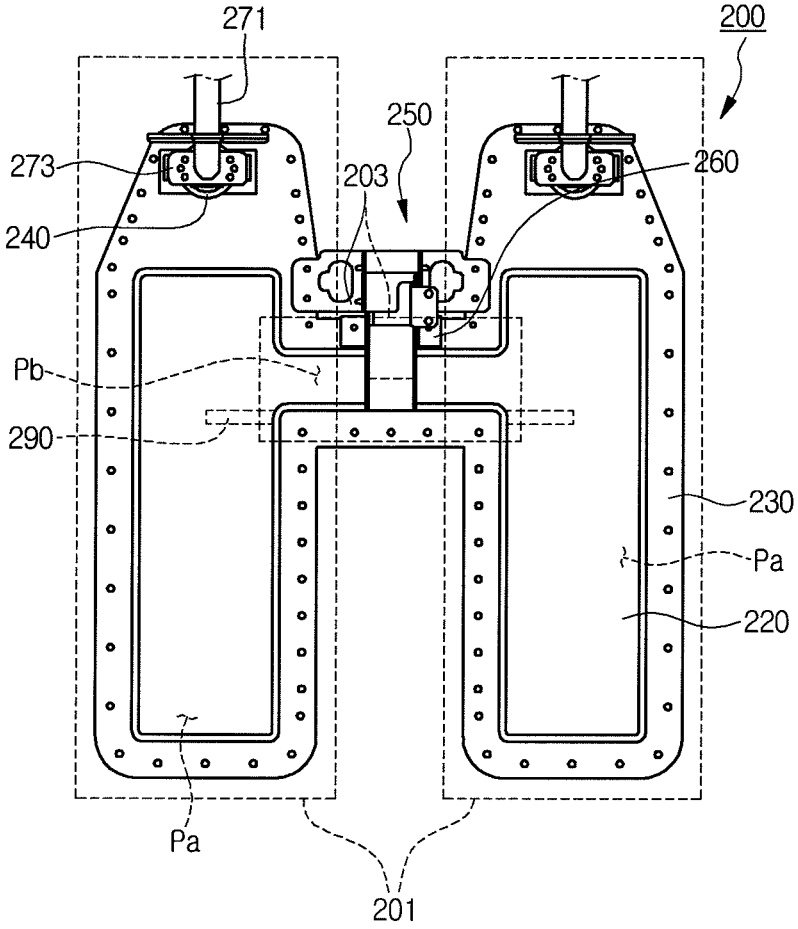
FIG. 12 is a plan view illustrating main parts of an upper broil burner of a cooker according to a fifth embodiment.

Hereinafter, an explanation will be given of a cooker according to a fifth embodiment with reference to the accompanying drawings. FIG. 12 is a plan view illustrating main parts of an upper broil burner of a cooker according to a fifth embodiment. In the second embodiment, the same elements as those of the first embodiment will be denoted by the same reference numerals used in FIGS. 1 to 7, and detailed descriptions thereof will not be repeated.

Referring to FIG. 12, in this embodiment, a long distribution member 290 is disposed in a length direction of a ignition flow passage Pb. The distribution member 290 extends from both ends of the ignition flow passage Pb toward the insides of combustion flow passages Pa. Outer ends of the distribution member 290 are spaced a predetermined distance from inner surface of a burner port 210 in a horizontal direction. The lower end of the distribution member 290 is spaced a predetermined from the stop surface of a combustion member 220 in a vertical direction. In other words, the distribution member 290 may block portions of the cross sections of the combustion flow passages Pa.

Therefore, when the mixture gas flows in the combustion flow passages Pa, some of the mixture gas flowing in regions of the combustion flow passages Pa overlapped with the distribution member 290 in a horizontal direction is guided to the ignition flow passage Pb. The other of the mixture gas flowing in regions of the combustion flow passages Pa not overlapped with the long distribution member 290 is allowed to continuously flow in the combustion flow passages Pa.

According to the embodiments, the inside of the cooking chamber of the cooker can be uniformly heated by the combustion compartments of the burner. Some of the mixture gas flowing in the combustion compartments is guided to the ignition compartment by the distribution member so that the mixture gas can be ignited in the ignition compartment. In the ignition compartment, the mixture gas can be ignited by using one ignition unit regardless of the number of the combustion compartments. Therefore, according to the embodiments, the cooking chamber can be uniformly heated by using a simple structure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

In the above-described embodiments, the terms upper and lower oven chambers are used to denote spaces for cooking food. Thus, the upper and lower oven chambers may also be referred to as upper and lower cooking chambers, respectively.

In the above-described embodiments, two combustion compartments are provided. However, the number of combustion compartments is not limited thereto. If three or more combustion compartments are provided, two or more ignition compartments may be provided. That is, the number of ignition compartments may be less than the number of combustion compartments by one.

In the above-described embodiments, the combustion compartments are arranged in parallel with each other. However, the combustion compartments are not limited to this arrangement. For example, the combustion compartments may cross each other. In addition, the lengths of flow passages of the combustion compartments may be varied. Both ends of the ignition compartment may be connected to the combustion compartments at positions spaced the same distance from the mixture gas receiving positions of the combustion compartments.

In the second embodiment, a second combustion flow passage parallel with the ignition flow passage is provided. However, it is understood that two or more second combustion flow passages may be provided. In the case, the number of the second combustion flow passages may be proportional to the number of the first combustion flow passages. However, a combination of two first combustion flow passages and two second combustion flow passages may also be possible.

In the above-described embodiments, the upper heating source includes the upper broil burner and the upper bake burner. In addition, the upper heating source may further include a convection device. Similarly, the lower heating source may further include a lower broil burner. In addition, one of the lower bake burner and the convection device of the lower heating source may be omitted. Moreover, like the upper broil burner, the upper bake burner, the lower broil burner, and the lower bake burner may be infrared burners.

The exemplary embodiments thus being described, it will be obvious that the same may be varied in many ways. Such variations are not to be regarded as a departure from the spirit and scope of this disclosure, and all such modifications as would be obvious to one skilled in the art are intended to be included within the scope of the following claims.

What is claimed is:

1. A burner comprising:

a burner port;

an ignition unit configured to ignite a mixture gas in the burner port; and a combustion member located between the burner port and the ignition unit, wherein portions of the burner port and the combustion member define a plurality of combustion compartments to allow combustion of the mixture gas in the compartments, wherein remaining portions of the burner port and the combustion member define an ignition compartment to allow ignition of the mixture gas supplied from the combustion compartments, and wherein the ignition compartment communicates with the plurality of combustion compartments, whereby a flame generated by igniting the mixture gas in the ignition compartment is propagated to the combustion compartments.

2. The burner according to claim 1, wherein each combustion compartment includes a flow passage, each flow passage having substantially the same length, and wherein the mixture gas is supplied to an end of each of the combustion compartments.

3. The burner according to claim 2, wherein opposite ends of the ignition compartment are connected to a corresponding combustion compartment at positions spaced the same distance from the ends of the combustion compartments through which the mixture gas is supplied into the combustion compartments.

4. The burner according to claim 3, wherein the opposite ends of the ignition compartment are close to the ends of the combustion compartments through which the mixture gas is supplied into the combustion compartments.

5. The burner according to claim 1, wherein the combustion compartments include:

a plurality of first combustion compartments having an elongated shape and arranged in parallel with each other; and a second combustion compartment connecting adjacent combustion compartments of the first combustion compartments.

6. The burner according to claim 5, wherein the first combustion compartments have substantially the same length, and wherein opposite ends of the second combustion compartment and opposite ends of the ignition compartment are connected to the corresponding first combustion compartments in a direction perpendicular to a length direction of the first combustion compartments.

7. The burner according to claim 6, wherein the second combustion compartment is disposed closer to downstream-side ends of the first combustion compartments in a flow direction of the mixture gas in the first combustion compartments, and the ignition compartment is disposed closer to upstream-side ends of the first combustion compartments in the flow direction of the mixture gas in the first combustion compartments.

8. A burner comprising:

a burner port including a flow passage to provide a mixture gas of air and gas;

a combustion member located on the flow passage; and an ignition unit configured to ignite the mixture gas, wherein the flow passage includes:

a plurality of combustion flow passages to which the mixture gas is supplied; and an ignition flow passage communicating with the combustion flow passages to receive the mixture gas, wherein a first surface portion of the combustion member is located in the ignition flow passage and second surface portions of the combustion member are located in corresponding combustion flow passages, and wherein, when the mixture gas is ignited by the ignition unit at the first surface portion of the combustion member, a flame is generated and propagated to the second surface portions of the combustion member corresponding to the combustion flow passages.

9. The burner according to claim 8, wherein an end of each of the combustion flow passages is connected to a mixing tube to receive the mixture gas.

10. The burner according to claim 9, wherein opposite ends of the ignition flow passage are connected to corresponding combustion flow passages at positions spaced the same distance from the mixing tubes.

11. The burner according to claim 8, wherein the mixture gas flows in the combustion flow passages in a direction crossing a direction in which the mixture gas flows in the ignition flow passage.

12. The burner according to claim 8, wherein the combustion flow passages include:

a plurality of first combustion flow passages configured to receive the mixture gas and deliver the mixture gas to the ignition flow passage; and a second combustion flow passage configured to allow flow of the mixture gas between the first combustion flow passages.

13. The burner according to claim 12, wherein the second combustion flow passage is connected to the first combustion flow passages at relatively downstream positions in a flow direction of the mixture gas in the first combustion flow passages as compared with positions at which the ignition flow passage is connected to the first combustion flow passages.

14. The burner according to claim 12, wherein the second combustion flow passage and the ignition flow passage are spaced predetermined distances from opposite ends of the first combustion flow passages.

15. The burner according to claim 12, wherein a flow direction of the mixture gas in the second combustion flow passage is parallel with a flow direction of the mixture gas in the ignition flow passage.

16. A cooker comprising:

a cavity part defining a cooking chamber configured to receive food;

a burner configured to supply heat to the cooking chamber for cooking food, the burner including:

a burner port;

an ignition unit configured to ignite a mixture gas in the burner port;

a combustion member located between the burner port and the ignition unit;

a plurality of mixing tubes connected to the burner port;

a plurality of combustion compartments defined by portions of the burner port and the combustion member to allow combustion of the mixture gas in the combustion compartments, each combustion compartment being in communication with a corresponding mixing tube; and an ignition compartment defined by the remaining portions of the burner port and the combustion member to allow ignition of the mixture gas supplied from the combustion compartments, whereby a flame generated by igniting the mixture gas in the ignition compartment is propagated to the combustion compartments; and a door configured to selectively close or open the cooking chamber.

17. The cooker according to claim 16, wherein a first surface of the combustion member corresponding to the ignition compartment is relatively smaller than second surfaces of the combustion member corresponding to the combustion compartments.

18. The cooker according to claim 16, wherein the same amounts of mixture gas are supplied to each of the combustion compartments, and wherein the second surfaces of the combustion member corresponding to the combustion compartments have the same area.

19. The cooker according to claim 16, wherein the combustion compartments include:

a plurality of first combustion compartments configured to receive the mixture gas; and a second combustion compartment configured to receive the mixture gas from the first combustion compartments.

20. The cooker according to claim 16, wherein the combustion compartments and the ignition compartment are symmetric with respect to an imaginary plane.

* * * * *